US007181908B2

(12) United States Patent
Naik

(10) Patent No.: US 7,181,908 B2
(45) Date of Patent: Feb. 27, 2007

(54) TORQUE COMPENSATION METHOD FOR CONTROLLING A DIRECT-INJECTION ENGINE DURING REGENERATION OF A LEAN NOX TRAP

(75) Inventor: Sanjeev M. Naik, Troy, MI (US)

(73) Assignee: General Motors Corporation, Detroit, MI (US)

( * ) Notice: Subject to any disclaimer, the term of this patent is extended or adjusted under 35 U.S.C. 154(b) by 113 days.

(21) Appl. No.: 10/812,466

(22) Filed: Mar. 30, 2004

(65) Prior Publication Data

US 2005/0217246 A1 Oct. 6, 2005

(51) Int. Cl.
*F01N 3/00* (2006.01)

(52) U.S. Cl. ..... 60/295; 60/274; 60/278; 60/285; 60/301; 123/295; 123/681; 701/103; 701/116

(58) Field of Classification Search ..... 60/274, 60/276, 285, 286, 295, 301; 123/295, 672, 123/681; 701/103, 104, 116
See application file for complete search history.

(56) References Cited

U.S. PATENT DOCUMENTS 5,437,153 A 8/1995 Takeshima et al.
6,041,592 A 3/2000 Huynh et al.
6,065,443 A 5/2000 Mizuno et al.
6,079,204 A * 6/2000 Sun et al. ..... 60/274
6,109,025 A * 8/2000 Murata et al. ..... 60/297
6,148,612 A 11/2000 Yamashita et al.
6,223,525 B1 5/2001 Takanohashi
6,237,329 B1 * 5/2001 Mizuno ..... 60/285
6,244,047 B1 * 6/2001 Brehob et al. ..... 60/295
6,253,546 B1 * 7/2001 Sun et al. ..... 60/285
6,293,092 B1 9/2001 Ament et al.
6,363,317 B1 * 3/2002 Druzhinina et al. ..... 701/104
6,370,868 B1 4/2002 Kolmanovsky et al.
6,539,709 B2 4/2003 Kubo et al.
6,564,774 B2 * 5/2003 Ellims et al. ..... 123/352
6,609,364 B2 * 8/2003 Litorell et al. ..... 60/274
6,620,392 B2 9/2003 Okamato et al.
6,708,668 B2 3/2004 Yoshida et al.
6,782,694 B2 8/2004 Nakagawa et al.
6,866,610 B2 * 3/2005 Ito ..... 477/43
7,021,045 B2 * 4/2006 Yomogida et al. ..... 60/285
7,051,517 B2 * 5/2006 Mehta et al. ..... 60/285

* cited by examiner

*Primary Examiner*—Tu M. Nguyen
(74) *Attorney, Agent, or Firm*—Kathryn A. Marra

(57) ABSTRACT

A torque compensation method for controlling a direct-injection gasoline engine during regeneration of a lean NOx trap disposed in an exhaust path of the engine determines a desired torque in accordance with driver demands, cruise control settings or idle control. An estimate of torque loss attributable to stratified to homogeneous transitioning to effect the regeneration is determined and a compensating control torque to the engine is provided in an amount sufficient to compensate for the estimated decrease in engine torque to thereby maintain the desired torque level during the lean NOx trap regeneration.

18 Claims, 6 Drawing Sheets

TORQUE COMPENSATION METHOD FOR CONTROLLING A DIRECT-INJECTION ENGINE DURING REGENERATION OF A LEAN NOX TRAP

TECHNICAL FIELD

The present invention relates to the control of an internal combustion engine and more particularly relates to a control strategy for regeneration of a lean NOx trap located in the exhaust path of a spark-ignition direct-injection engine which allows for maintaining a desired torque during lean NOx trap regeneration events.

BACKGROUND OF THE INVENTION

It is known in the art relating to internal combustion engines that by operating an engine with a less than stoichiometric (lean) mixture of fuel and air, efficiency of the engine is improved. This means that for a given amount of work performed by the engine, less fuel will be consumed, resulting in improved fuel efficiency. It is also well known that reduction of NOx emissions when the fuel rate is lean has been difficult to achieve, resulting in an almost universal use of stoichiometric operation for exhaust control of automotive engines. By operating an engine with a stoichiometric mixture of fuel and air, fuel efficiency is good and NOx emission levels are reduced by over 90% once the vehicle catalyst reaches operating temperatures.

Recent developments in catalysts and engine control technologies have allowed lean operation of the engine, resulting in improved fuel efficiency and acceptable levels of NOx emissions. One such development is a NOx adsorber (also termed a "lean NOx trap" or "LNT"), which stores NOx emissions during fuel lean operations and allows release of the stored NOx during fuel rich conditions with conventional three-way catalysis to nitrogen and water. The adsorber has limited storage capacity and must be regenerated with a fuel rich reducing "pulse" as it nears capacity. It is desirable to control the efficiency of the regeneration event of the adsorber to provide optimum emission control and minimum fuel consumption. It is further desirable to control the efficiency of the regeneration event of the adsorber to provide optimum emission control and minimum fuel consumption while at the same time minimizing or eliminating altogether any adverse impact on driveability. Various strategies have been proposed.

Commonly assigned U.S. Pat. No. 6,293,092 to Ament et al. entitled "NOx adsorber system regeneration fuel control" discloses a method for controlling regeneration fuel supplied to an internal combustion engine operating with a lean fuel-air mixture during sequential rich mixture regeneration events of a NOx adsorber in which NOx emissions collected by the adsorber are purged to provide optimum emissions control and minimum fuel consumption. The method monitors the exhaust gases flowing out of the adsorber during the regeneration event to detect when the fuel-air mixture to the engine is within an excessively lean or rich range. When the sensed exhaust gases contain an excessively lean fuel-air mixture, fuel is increased to the engine. Fuel is decreased when the sensed exhaust gases contain an excessively rich fuel-air mixture. The fuel can be increased or decreased by adjusting the duration or fuel rate of the regeneration event. U.S. Pat. No. 6,293,092 is hereby incorporated by reference.

In the art related to spark-ignition direct-injection (SIDI) engines, it is known to operate the engine in a stratified charge mode (very lean operation) in a lower range of engine output and in a homogeneous mode (less lean, stoichiometric, or rich of stoichiometric operation) in a higher range of engine power output with an intermediate zone wherein the cylinders operate in a combination of stratified charge and homogeneous charge combustion. In the stratified charge mode, the fuel is injected during the piston compression stroke, preferably into a piston bowl from which it is directed to a spark plug for ignition near the end of the compression stroke. The combustion chambers contain stratified layers of different air/fuel mixtures. The stratified mode generally includes strata containing a stoichiometric or rich air/fuel mixture nearer the spark plug with lower strata containing progressively leaner air/fuel mixtures. In the homogeneous charge mode, fuel is injected directly into each cylinder during its intake stroke and is allowed to mix with the air charge entering the cylinder to form a homogeneous charge, which is conventionally ignited near the end of the compression stroke. The homogenous mode generally includes an air/fuel mixture that is stoichiometric, lean of stoichiometric or rich of stoichiometric.

Typically, there is a first range of air-fuel ratios within which stable combustion can be achieved in the stratified charge mode, such as between 25:1 and 40:1, and a second range in which stable combustion can be achieved in the homogeneous mode, such as between 12:1 and 20:1. Therefore, there is typically a significant gap between the leanest air-fuel ratio of the homogenous mode (in this example 20) and the richest air-fuel ratio of the stratified mode (in this example 25). This gap poses a number of challenges in selecting an appropriate operating mode and controlling the engine during transitions between operating modes. For example, careful control of engine operation is necessary to deliver the demanded torque without adversely affecting driveability when switching from the stratified to the homogenous mode or vice versa.

It is known in the art to coordinate valve timing during mode transitions to reduce engine torque variations. Methods to control individual engine variables during normal, single-mode operation as a lean NOx trap regeneration engine control strategy have also been proposed. But control of individual engine parameters can result in unacceptably rough operation. Transient control of fuel injection timing similar to other variables has also been proposed. But this can produce oscillatory behavior resulting from engine misfire.

Commonly assigned co-pending U.S. patent application Ser. No. 10/812,584 filed Mar. 30, 2004, the disclosure of which is hereby incorporated by reference herein in its entirety, describes a method to control a direct-injection gasoline engine during LNT regeneration events thereby improving driveability by timing transitions to homogeneous operation in accordance with fuel/air equivalence ratio considerations. Further, commonly assigned co-pending U.S. patent application Ser. No. 10/812,467 filed Mar. 30, 2004 also directed to a control strategy for lean NOx trap regeneration whereby the number of regeneration events carried out when a lean burn SIDI engine is otherwise running in a stratified mode are minimized, is hereby incorporated by reference herein in its entirety. However, lean NOx trap regenerations are still required under some stratified mode operating conditions and there is usually potential for undesirable degraded driveability during the occurrence of such regeneration events.

Therefore, there remains a need in the art for further advances in the control of engine operation during lean NOx trap regeneration. There further remains a need in the art for methods providing comprehensive coordinated control of engine operation during mode transitions associated with LNT regeneration that enable LNT regeneration to occur without adversely impacting driveability or NOx emissions at the tailpipe, particularly for mixed mode spark-ignition direct-injection (SIDI) engines.

SUMMARY OF THE INVENTION

The present invention applies to all direct-injection gasoline engines including spark-ignition direct-injection engines. The invention enables improved driveability for such powertrains. The invention enables direct-injection gasoline engine powered vehicles to have good driveability while meeting stringent emissions targets (especially for NOx) and minimally impacting the fuel economy benefits of such powertrains. The engine control system comprises torque based engine controls wherein the system is responsive to desired torque inferred from driver input.

The present invention includes a method for further improving driveability by compensating for increased parasitic losses in the engine arising from increased pumping work required during regeneration events. During lean NOx trap (LNT) regeneration homogeneous operation is invoked and air intake is throttled. Torque is then lost due to pumping against the air restriction. The present invention compensates for this loss by applying a compensating torque control. In an important aspect of the invention, the compensating torque control comprises applying increased fueling as needed. Secondarily, the compensating torque control may additionally include adjusting engine control variables such as, but not limited to, spark and fuel injection timing.

A spark-ignited direct-injection engine includes a NOx trap for adsorbing NOx emissions during stratified lean engine operation. During regeneration of the NOx trap, the engine is operated in a homogeneous rich mode. A base torque is determined such as in response to an operator torque request from throttle pedal position, a cruise control setting or an idle speed controller. Engine torque decrease which would result from a transition from stratified operation to homogenous operation during regeneration are estimated. Such torque decrease is compensated for by applying a compensating control torque to the engine in an amount sufficient to compensate for the estimated decrease in engine torque to thereby maintain the base desired torque level during the regeneration. In a preferred embodiment, applying a compensating control torque includes increasing fueling slightly with the fueling being increased to an amount sufficient to maintain the base torque.

The invention is implemented in a system including means for estimating a decrease in engine torque which would result from transitioning from stratified lean engine operation to homogeneous rich engine operation during a lean NOx trap regeneration. Means for applying a compensating control torque to the engine in an amount sufficient to compensate for the estimated decrease in engine torque are provided to thereby maintain the base desired torque level during the lean NOx trap regeneration.

An engine controller includes a storage medium having a computer program encoded therein for effecting coordinated control of engine operation and regeneration of a lean NOx trap disposed in an exhaust path of a direct-injection gasoline engine. The program includes code for carrying out the method of the invention including code for determining a base desired torque, code for estimating a decrease in engine torque that would result from transitioning from stratified lean engine operation to homogeneous rich engine operation during a lean NOx trap regeneration, and code for applying a compensating control torque to the engine in an amount sufficient to compensate for the estimated decrease in engine torque thereby maintaining the base desired torque level during the lean NOx trap regeneration.

These and other features and advantages of the invention will be more fully understood from the following description of certain specific embodiments of the invention taken together with the accompanying drawings.

BRIEF DESCRIPTION OF THE DRAWINGS

Referring now to the drawings, which are meant to be exemplary, not limiting, and wherein like elements are numbered alike in the several Figures.

DESCRIPTION OF THE PREFERRED EMBODIMENT

Figure 1:
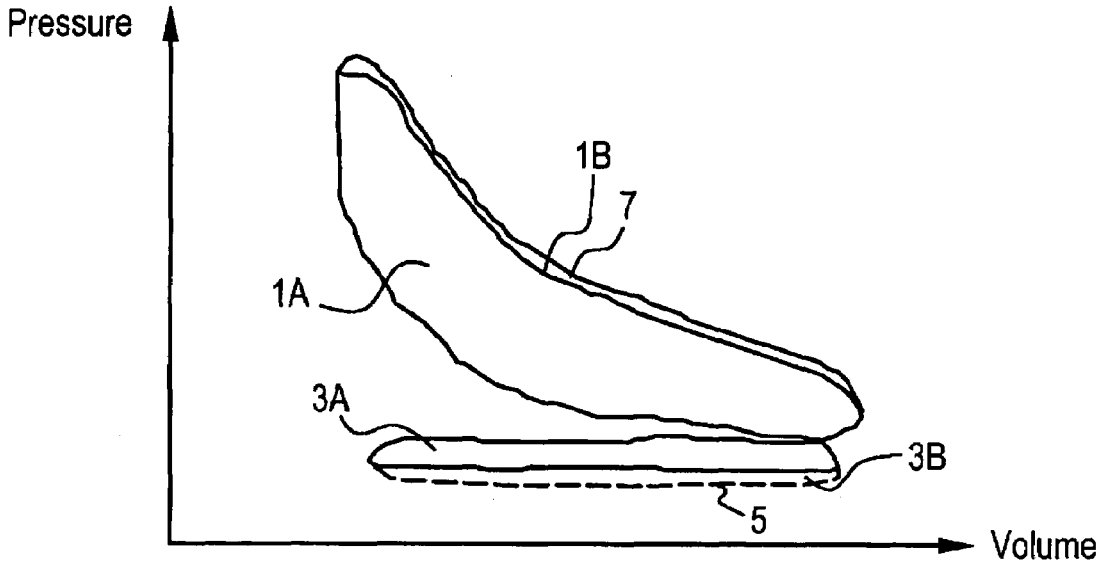
FIG. 1 is a diagram showing control achieved in accordance with the method of the invention in a pressure versus volume diagram.

An important aspect of the invention addresses the issue that during an LNT regeneration event, the engine must perform increased pumping work due to the increased throttling associated with running rich. The invention describes a method to estimate the loss of torque that results due to this increased pumping work and then compensate for this loss by increasing fueling slightly in an amount sufficient to maintain the desired torque level (that is, to effect the step of applying a compensating control torque). It is noted that spark is not preferred as a control variable, since limited torque increase authority is expected through spark adjustment. This concept is illustrated in the diagram of FIG. 1 showing pressure (vertical axis) versus volume (horizontal axis) changes associated with the transition from stratified engine operation to rich homogenous operation during LNT regeneration. In FIG. 1, the area denoted as area 1A represents the combustion work performed by the engine, whereas area 3A represents the pumping work. Under increased throttling, as during an LNT regeneration event, the pumping work increases, as illustrated by the expanded area 3B which includes the pumping work denoted by the area 3A plus the additional pumping work encompassed by the dotted line 5. The invention contemplates creating combustion work to compensate for the increased pumping work, as illustrated by increasing the combustion work to encompass area 1B including the combustion work denoted by the area 1A plus the additional combustion work encompassed by the solid line 7.

Figure 2:
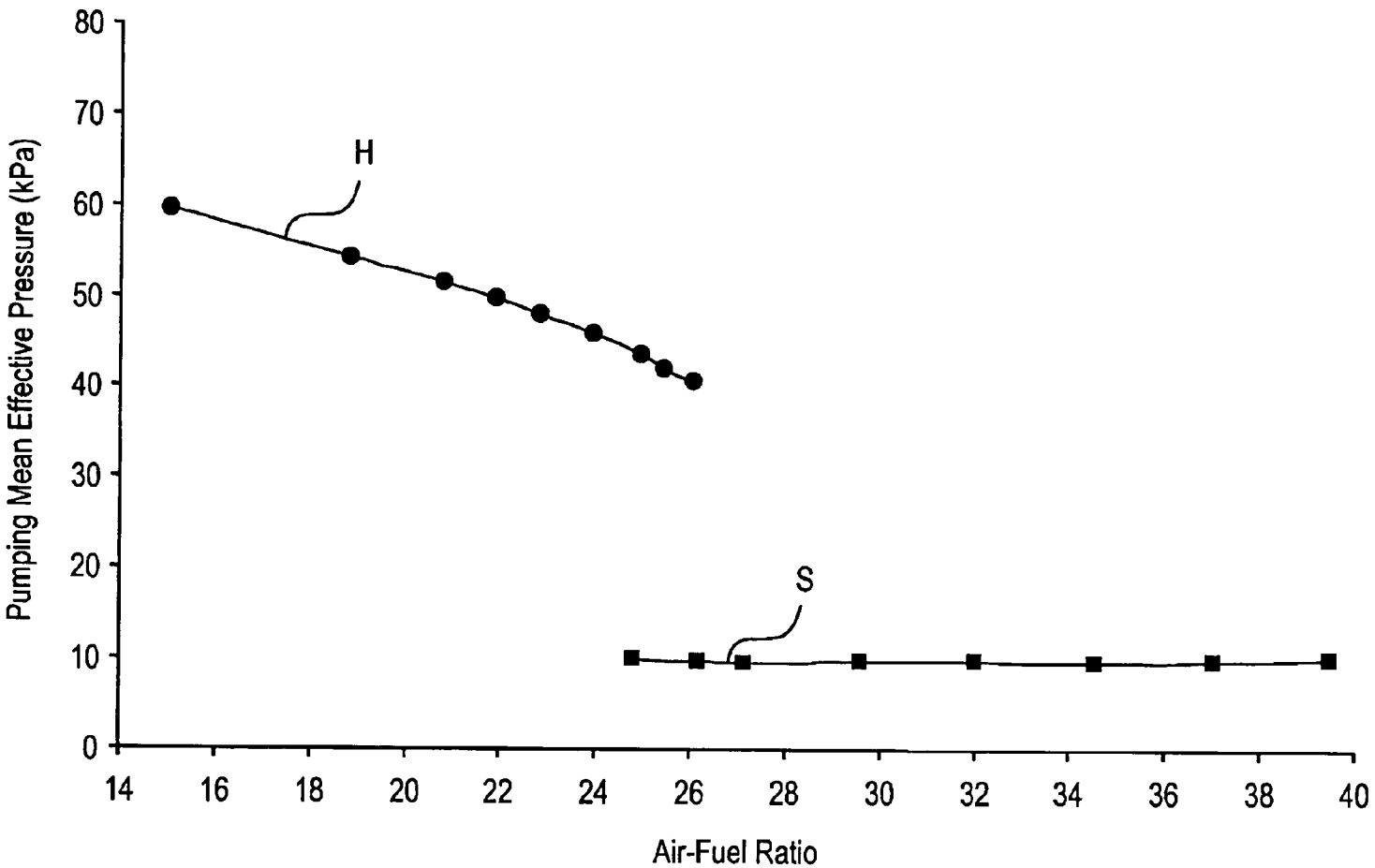
FIG. 2 is a graph showing pumping mean effective pressure versus air-fuel ratio for a given engine load.

Turning to FIG. 2, the difference in pumping mean effective pressure (PMEP) across a wide range of air-fuel ratios is illustrated for an engine load brake mean effective pressure (BMEP) of substantially 265 kPa. Homogenous operation is illustrated by line H for a premixed, lean intake mixture with a swirl index (SI) of 3.3 at 45° C. Stratified operation is illustrated by line S for a stratified, lean intake mixture with exhaust gas recirculation (EGR) with an SI of 1.9 at 95° C. In particular, it can be seen that PMEP is much higher under homogeneous operation than it is under stratified operation for the same air-fuel ratio (e.g. 24–26 air-fuel ratio). This is a consequence of the increased throttling under homogeneous operation. Specifically, the increase in PMEP is about 30 to about 50 kilopascals (kPa) for the illustrated engine load BMEP of 265 kPa.

At the initiation of a lean NOx trap regeneration event, the since desired air-fuel ratios before and after event initiation are known and hence the corresponding values of the desired air charge per cylinder (Des $m_{air,cyl}$) and the desired exhaust gas recirculation (EGR) mass fraction $$\left(\frac{Des\ \%\ EGR}{100}\right)$$

prior to and after the LNT regeneration event are known. Therefore, the change in intake manifold pressure (MAP) that would result due to this transition as well, assuming the intake manifold temperature ($T_{man}$) and volumetric efficiency ($\hat{\eta}_{volumetric\ efficiency}$) do not change by the same scale as the change in intake gas charge during this event can readily be estimated. In fact, the control reference value for MAP, denoted by $P_{ref}$, is given by $$P_{ref} = \frac{4RT_{man}}{V_d}\frac{\left(1+\frac{Des\ \%\ EGR}{100}\right)Des\ m_{air,cyl}}{\hat{\eta}_{volumetric\ efficiency}} \tag{1}$$

This implies that the change in MAP due to initiation of an LNT regeneration event can be known just prior to the actual event. This can be seen by noting that the change in the control reference value for MAP ($\Delta P_{ref}$) can be approximated by $$\Delta P_{ref} \approx \frac{4RT_{man}}{V_d}\frac{\Delta\left(1+\frac{Des\ \%\ EGR}{100}\right)Des\ m_{air,cyl}}{\hat{\eta}_{volumetric\ efficiency}} \tag{2}$$

where $V_d$ denotes engine displacement volume, and

R denotes the gas constant.

The actual air charge per cylinder and actual EGR mass fraction converges to their respective desired values in accordance with the conventional functioning of the air charge and EGR controllers. Therefore, the resulting change in intake manifold pressure can be estimated well.

Next, if the change in exhaust back pressure due to this transition is negligible compared to the change in MAP, then the change in pumping work may be attributed mainly to the change in MAP. Specifically, the change in pumping mean effective pressure (PMEP) is given by $$\Delta PMEP = \frac{\Delta\int_{\substack{pumping\\loop}} P\,dV}{V_d} \approx \frac{V_d\Delta P_{exhaust} - V_d\Delta P_{man}}{V_d} \approx -\Delta P_{man} \tag{3}$$

This relationship quantifies the increase in PMEP that results from the decrease in MAP due to the increased throttling during NOx regeneration.

Finally, this yields an estimate of the resulting change in brake torque.

$$\Delta T \approx \frac{RT_{man}}{\pi}\frac{\Delta\left(1+\frac{Des\ \%\ EGR}{100}\right)Des\ m_{air,cyl}}{\hat{\eta}_{volumetric\ efficiency}} \tag{4}$$

Knowing an estimate of the possible loss in brake torque, the invention provides compensation for such loss by increasing the torque an amount approximately equal to $-\Delta T$ to maintain the torque desired by the controlling entity (e.g., the driver or a controller such as a cruise controller or idle speed controller).

Figure 3:
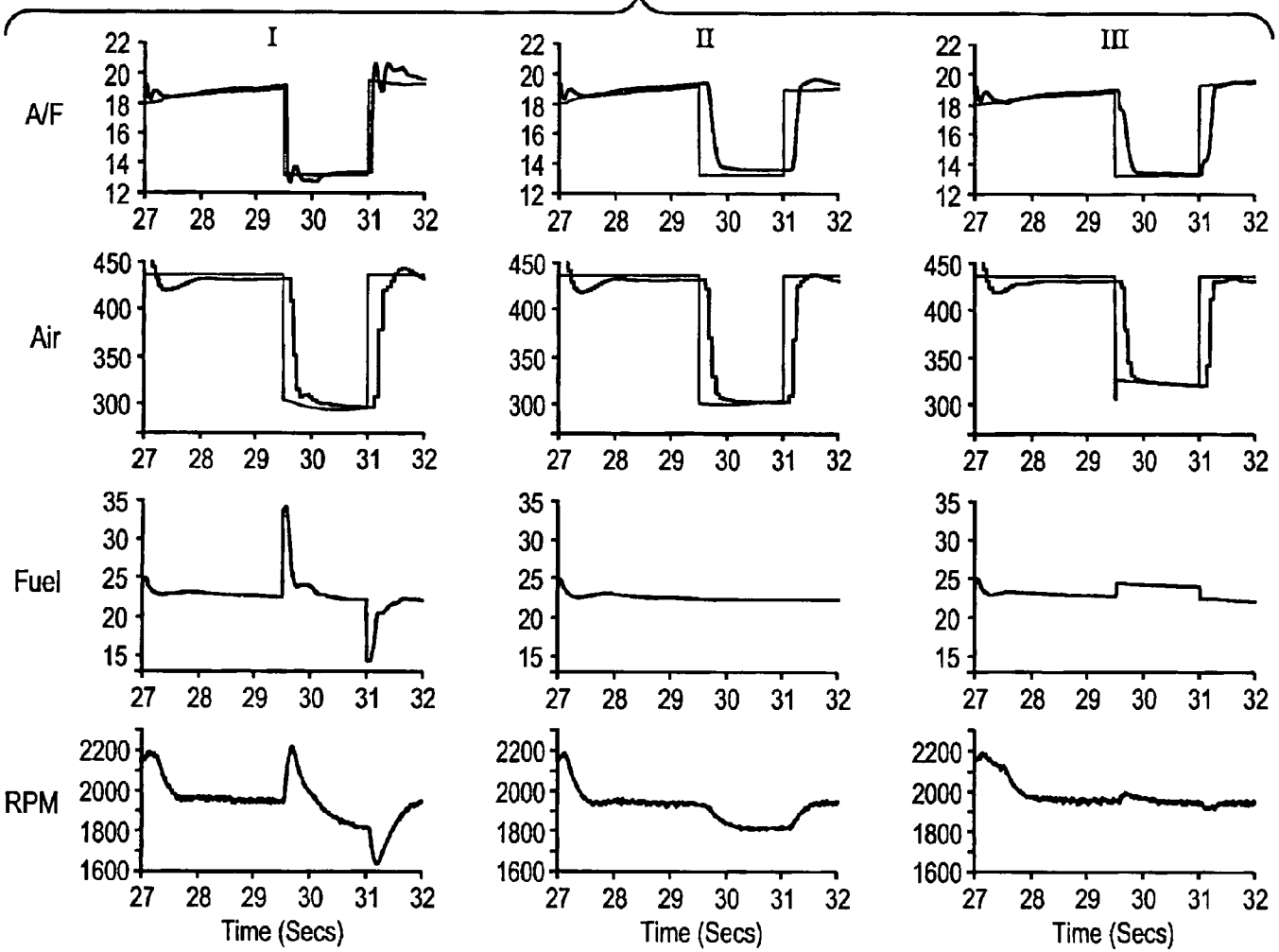
FIG. 3 is a graph illustrating a closed-loop simulation of LNT regeneration in accordance with the invention.

FIG. 3 shows the benefits of this concept as determined through a closed-loop simulation. The simulation results provide air and fuel (in milligrams) ingested into the engine per firing event. Columns I and II illustrate the change in engine speed in the RPM row resulting from alternate methods of controlling the engine, including purely air-fuel ratio feedback-based control and constant fueling control. Column III illustrates how use of the present control strategy results in minimal change in engine speed throughout the LNT regeneration event.

Figure 4:
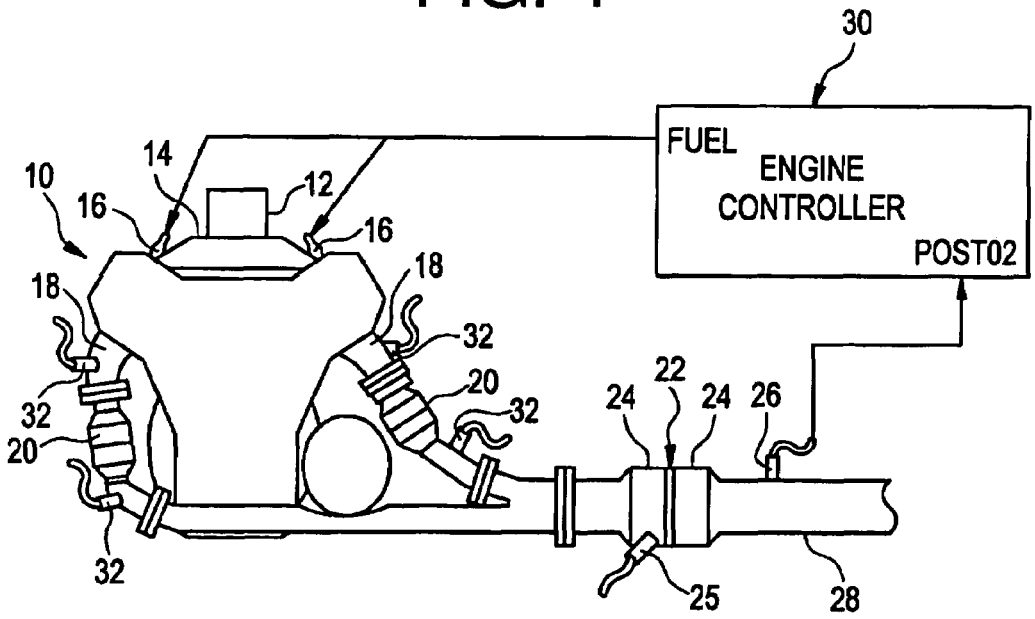
FIG. 4 is a block diagram showing generally a SIDI engine and engine control hardware in accordance with the invention.

Turning now to FIG. 4, a block diagram showing one possible embodiment of a system for carrying out the present invention includes a spark-ignition direct-injection engine 10 having an air intake 12 for admitting a flow of air into the engine 10 through intake manifold 14 by control of air throttle valves (not shown). Electronically-controlled fuel injectors 16 are disposed in the engine 10 for metering fuel thereto. The air-fuel mixtures are then burned in engine cylinders (not shown).

Exhaust gases produced in the engine cylinder combustion process flow out of the engine cylinders and through one or more exhaust gas conduits 18. A catalytic device such as a three-way converter 20 is connected to the exhaust gas conduit 18 to treat or clean the exhaust gases. From the catalytic device 20, the exhaust gases pass through a lean NOx trap 22 including two elements 24 and, optionally, a temperature sensor 25 (temperature sensor 25 is not required if code is employed to estimate the LNT temperature). An air-fuel ratio sensor 26, such as a post-LNT wide range sensor or a conventional switching-type $O_2$ sensor, is disposed within the tailpipe 28 for monitoring the concentration of available oxygen in the exhaust gases and providing an output voltage signal $POSTO_2$ which is received and analyzed by an engine controller 30. The controller 30 is a conventional engine controller including ROM, RAM and CPU and includes a software routine 200 (described in FIG. 3) for performing the method of the present invention. The controller 30 controls fuel injectors 16, which inject fuel into their associated cylinders (not shown) in precise quantities and timing as determined by the controller 30. The controller 30 transmits a fuel injector signal to the fuel injectors 16 to maintain an air-fuel ratio determined by the controller including fuel, air, air/fuel ratio, EGR, spark, swirl control valve, and fuel injection timing in accordance with the present control strategy. Additional sensors (not shown) provide other information about engine performance to the controller 30, such as crankshaft position, angular velocity, throttle and air temperature. Additionally, other oxygen sensors 32 variously placed may provide additional control information. The information from these sensors is used by the controller 30 to control engine operation.

Figure 5:
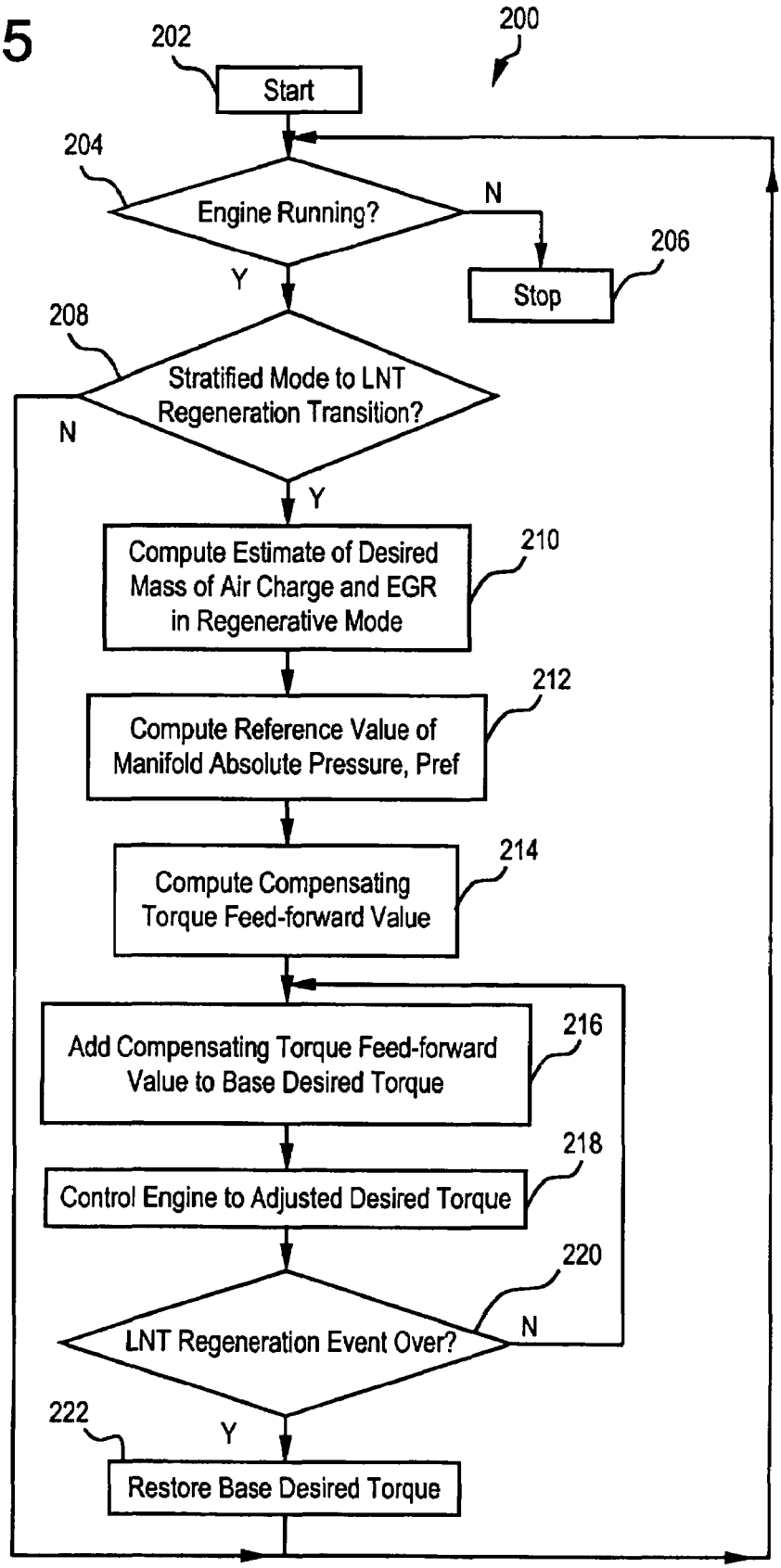
FIG. 5 is a computer flow chart illustrating a flow of operations for carrying out the control strategy for lean NOx trap regeneration in accordance with the invention.

Turning now to FIG. 5, a flowchart of a software routine 200 for performing the method for controlling a lean burn direct-injection engine during lean NOx trap regeneration in accordance with the invention is shown. This routine would be entered periodically from the main engine control software located in engine controller 30. Block 202 indicates the start of the routine for carrying out the present invention, which is performed in the inner control loop of a hierarchical torque-based engine control system with an overall torque command that must be maintained. The invention contemplates coordinated control of fuel, air, air/fuel ratio, exhaust gas recirculation, spark, swirl control valve, and fuel injection timing to enable smooth engine operation during lean NOx trap regeneration.

At block 204, a determination is made as to whether or not the engine is running. If the engine is not running, the routine is exited as at block 206. If the engine is running, a determination is made as to whether the engine is operating in a stratified mode at the start of a lean NOx trap regeneration event thereby requiring a transition out of stratified engine operation as indicated at block 208, for example as disclosed in commonly assigned, co-pending U.S. patent application Ser. No. 10/812,467. If the engine is not transitioning from stratified mode for the lean NOx trap regeneration transition, the routine is exited.

If the engine is transitioning from a stratified mode for a lean NOx trap regeneration transition, the estimate of the desired mass of air charge and EGR for the regenerative mode is computed as at block 210.

At block 212, the preferred reference value of manifold absolute pressure is computed. At block 214, the compensating torque feed-forward value sufficient to maintain the base desired torque level during the lean NOx trap regeneration event is computed. The compensating torque feed-forward value is added to the predetermined base desired torque as at bock 216.

At block 218, the engine is controlled to operate at the adjusted desired torque (i.e., the base desired torque is maintained by applying the compensating feed-forward torque to offset the loss in braking torque).

A determination is made as to whether the lean NOx trap regeneration event is over as at block 220, e.g. as disclosed in commonly assigned, co-pending U.S. patent application Ser. No. 10/812,467 and commonly assigned U.S. Pat. No. 6,293,092. If the lean NOx trap regeneration event is not over, the routine returns to block 216 to continue controlling engine operation as described. If the lean NOx trap regeneration event is over, the step of applying a compensating control torque is ended, the base desired torque is restored as at block 222, and the routine is exited.

Figure 6:
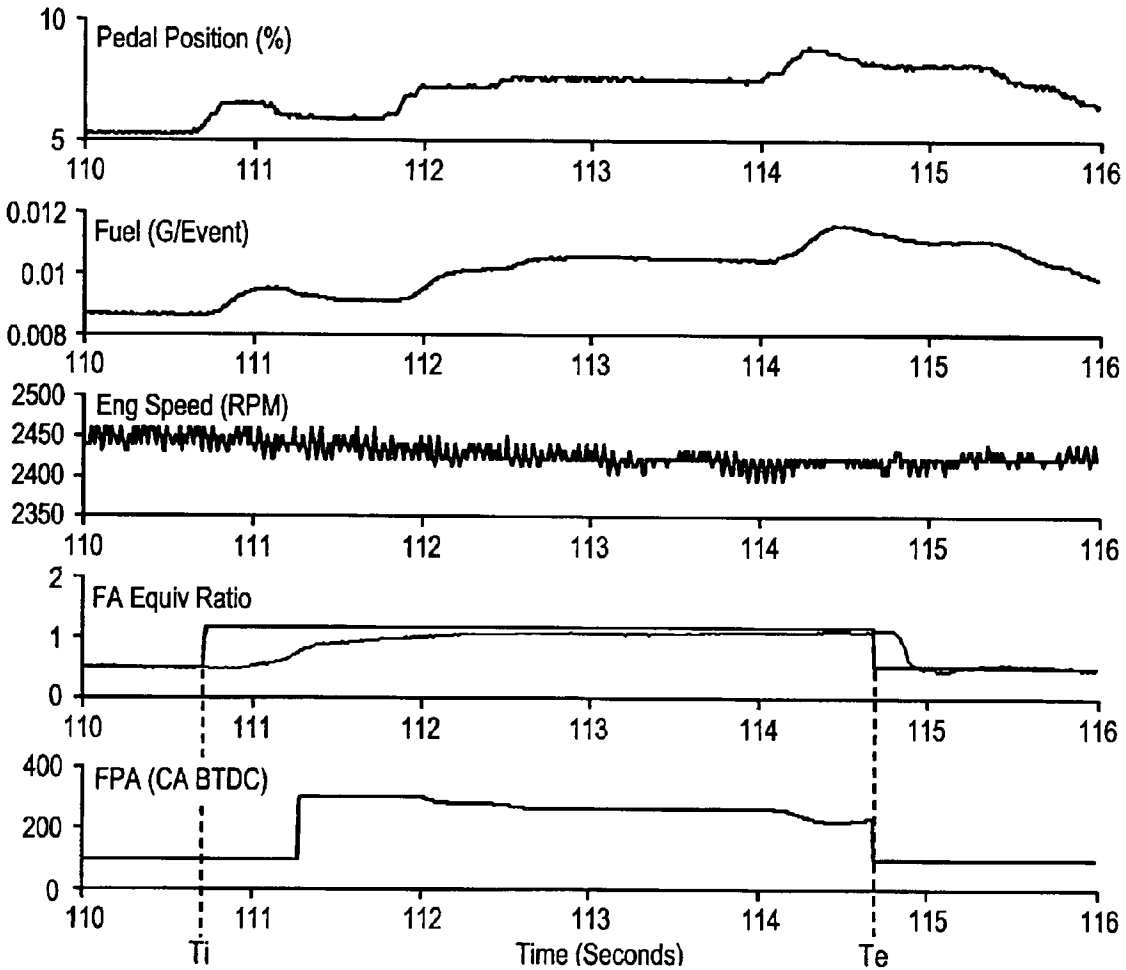
FIG. 6 is a graph illustrating coordinated engine control for LNT regeneration without the torque compensation of the invention; and, FIG. 7 is a graph illustrating coordinated engine control for LNT regeneration with fueling torque compensation in accordance with the invention.
Figure 7:
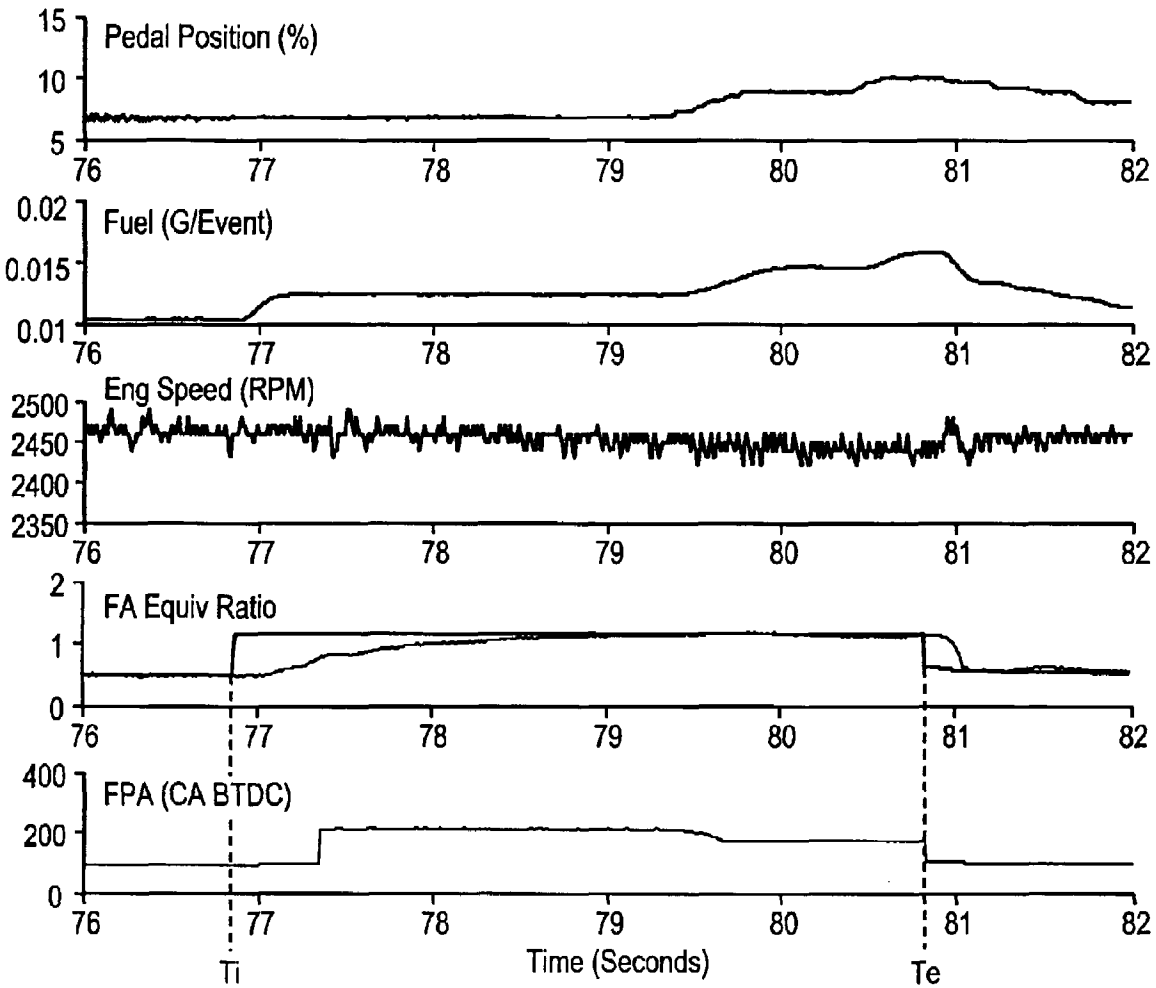

This concept has been implemented on a prototype vehicle equipped with a spark-ignited direct-injection engine. FIGS. 6 and 7 show measured data on this prototype vehicle during a test in which the vehicle was driven at a speed of 70 kph. FIG. 6 illustrates selected variables Including throttle pedal position (Pedal position), fueling (Fuel), engine speed (Eng speed), fuel-air equivalence ratio (FA Equiv ratio), and fuel injection timing or fuel pulse angle (FPA). Here, fueling is in grams injected per engine firing event, engine speed is in RPM, and FPA is in crank angle degrees before top dead center. This measured data is for a lean NOx trap regeneration event with coordinated engine control including fuel/air equivalence ratio considerations carried out substantially as described in commonly assigned, co-pending U.S. patent application Ser. No. 10/812,584 filed Mar. 30, 2004 and Ser. No. 10/812,467 but without the benefit of the present torque compensation as described herein. A lean NOx trap regeneration event is initiated just before 111 seconds (time Ti) and ends before 115 seconds (time Te). FIG. 6 shows that the engine speed drops by substantially 50 RPM over this event.

FIG. 7 shows selected variables for a similar lean NOx trap regeneration event while employing the present torque compensation control method. FIG. 7 illustrates the improvement that results in terms of a smaller drop in engine speed during the lean NOx trap regeneration event due to the present torque compensation control.

While the invention has been described by reference to certain preferred embodiments, it should be understood that numerous changes could be made within the spirit and scope of the inventive concepts described. Accordingly, it is intended that the invention not be limited to the disclosed embodiments, but that it have the full scope permitted by the language of the following claims.

The invention claimed is:

1. Method for controlling a direct-injection gasoline engine during regeneration of a lean NOx trap disposed in an exhaust path of the engine, the regeneration characterized by a transition from stratified lean engine operation to homogeneous rich engine operation, the steps of the method comprising:

(a) computing a feed-forward compensating torque, which consists of a single estimate for decreased engine torque during the regeneration of the lean NOx trap resulting from the transition from stratified lean engine operation to homogeneous rich engine operation;

(b) determining a base desired torque to be provided by the engine;

(c) increasing the based desired torque by the feed-feed forward compensating torque to obtain an adjusted desired torque;

(d) controlling engine operation based upon the adjusted desired torque; and (e) repeating steps (b) through (d) during the regeneration of the lean NOx trap, thereby using the single estimate for the feed-forward compensating torque to compensate for decreased engine torque resulting from the homogeneous rich engine operation.

2. The method of claim 1, wherein the single estimate for the feed-forward compensating torque in step (a) is computed based upon air-fuel ratios associated with the stratified lean engine operation and the homogeneous rich engine operation prior to and after initiation of the regeneration of the lean NOx trap.

3. The method of claim 1, wherein the single estimate for the feed-forward compensating torque in step (a) is computed based upon desired engine air charge per cylinder and exhaust gas recirculation mass fraction associated with the stratified lean engine operation and the homogeneous rich engine operation prior to and after initiation of the regeneration of the lean NOx trap.

4. The method of claim 1, wherein the step (d) of controlling engine operation is accomplished by adjusting engine fueling amount based upon the adjusted desired torque.

5. The method of claim 1, wherein the step (b) of determining a base desired torque is accomplished in accordance with one of a throttle pedal position, a cruise control setting and an idle speed control.

6. The method of claim 1, wherein the step (e) further includes: determining an end of the regeneration of the lean NOx trap, after which engine operation is controlled based upon the base desired torque.

7. System for controlling a direct-injection gasoline engine during regeneration of a lean NOx trap disposed in an exhaust path of the engine, the regeneration characterized by a transition from stratified lean engine operation to homogeneous rich engine operation, comprising:

means for computing a feed-forward compensating torque, which consists of a single estimate for decrease in engine torque during the regeneration of the lean NOx trap resulting from the transition from stratified lean engine operation to homogeneous rich engine operation;

means for performing a first operation of determining a base desired torque to be provided by the engine;

means for performing a second operation of increasing the determined based desired torque by the feed-forward compensating torque to obtain an adjusted desired torque;

means for performing a third operation of controlling engine operation based upon the adjusted desired torque; and means for repeating the first, second, and third operations during the regeneration of the lean NOx trap, thereby using the single estimate for the feed-forward compensating torque to compensate for decreased engine torque resulting from the homogeneous rich engine operation.

8. The system of claim 7, wherein the single estimate for the feed-forward compensating torque is computed based upon air-fuel ratios associated with the stratified lean engine operation and the homogeneous rich engine operation prior to and after initiation of the regeneration of the lean NOx trap.

9. The system of claim 7, wherein the single estimate for the feed-forward compensating torque is computed based upon air charge per cylinder and exhaust gas recirculation mass fraction associated with the stratified lean engine operation and the homogeneous rich engine operation prior to and after initiation of the regeneration of the lean NOx trap.

10. The system of claim 7, wherein the means for performing the third operation is accomplished by adjusting engine fueling amount based upon the adjusted desired torque.

11. The system of claim 7, wherein the desired base torque is determined based upon one of a throttle position, a cruise control setting and an idle speed control.

12. The system of claim 7, wherein the means for repeating the first, second, and third operations includes an operation for determining an end of the regeneration of the lean NOx trap, after which engine operation is controlled based upon the base desired torque.

13. Article of manufacture comprising a storage medium having a computer program encoded therein for effecting coordinated control of engine operation and regeneration of a lean NOx trap disposed in an exhaust pat of a direct-injection gasoline engine, the regeneration characterized by a transition from stratified lean engine operation to homogeneous rich engine operation, the program comprising:

code for computing a feed-forward compensation torque, which consists of a single estimate for decreased engine torque during the regeneration of the lean NOx trap resulting from the transition from stratified lean engine operation to homogeneous rich engine operation;

code for performing a first operation of determining a base desired torque to be provided by the engine;

code for performing a second operation of increasing the base desired torque by the feed-forward compensating torque to obtain an adjusted desired torque;

code for performing a third operation of controlling engine operation based upon the adjusted desired torque; and code for repeating the first, second, and third operations during the regeneration of the lean NOx trap, thereby using the single estimate for the feed-forward compensating torque to compensate for decreased engine torque resulting from the homogeneous rich engine operation.

14. The article of claim 13, wherein the single estimate for the feed-forward compensating torque is computed based upon air-fuel ratios associated with the stratified lean engine operation and the homogeneous rich engine operation prior to and after initiation of the regeneration of the lean NOx trap.

15. The article of claim 13, wherein the single estimate for the feed-forward compensating torque is computed based upon air charge per cylinder and exhaust gas recirculation mass fraction associated with the stratified lean engine operation and the homogeneous rich engine operation prior to and after initiation of the regeneration of the lean NOx trap.

16. The article of claim 13, wherein the third operation is accomplished by adjusting engine fueling amount based upon the adjusted desired torque.

17. The article of claim 13, wherein the desired base torque is determined based upon one of a throttle position, a cruise control setting, and an idle speed control.

18. The article of claim 13, wherein the code for repeating the first, second, and third operations further includes code for determining an end of the regeneration of the lean NOx trap, after which engine operation is controlled based upon the base desired torque.

* * * * *